US010424230B1

(12) United States Patent
Peloquin

(10) Patent No.: US 10,424,230 B1
(45) Date of Patent: Sep. 24, 2019

(54) RETRACTABLE BANNER

(71) Applicant: Bruce C. Peloquin, Milford, MA (US)

(72) Inventor: Bruce C. Peloquin, Milford, MA (US)

(73) Assignee: Fourstar Group Inc., Taipei (TW)

( * ) Notice: Subject to any disclaimer, the term of this patent is extended or adjusted under 35 U.S.C. 154(b) by 11 days.

(21) Appl. No.: 15/435,436

(22) Filed: Feb. 17, 2017

(51) Int. Cl.

| | |
|---|---|
| ***G09F 7/00*** | (2006.01) |
| ***G09F 17/00*** | (2006.01) |
| ***G09F 15/00*** | (2006.01) |
| ***G09F 7/18*** | (2006.01) |

(52) U.S. Cl.
CPC ..... *G09F 17/00* (2013.01); *G09F 7/18* (2013.01); *G09F 15/0025* (2013.01); *G09F 15/0062* (2013.01); *G09F 2007/1834* (2013.01); *G09F 2007/1886* (2013.01)

(58) Field of Classification Search
CPC ..... G09F 11/18–29; G09F 2007/1886; Y10T 24/45963
See application file for complete search history.

(56) References Cited

U.S. PATENT DOCUMENTS 3,187,761 A * 6/1965 De Maio ..... E04H 15/003 135/118
3,195,898 A * 7/1965 Respini ..... A63B 63/00 135/118
4,848,437 A * 7/1989 Laniado ..... B60J 1/2041 160/238
5,176,774 A * 1/1993 Laniado ..... B60J 1/2041 135/117
5,333,880 A * 8/1994 Allbright ..... A63B 71/021 473/493
D399,261 S * 10/1998 Humphrey ..... D20/41
5,884,424 A * 3/1999 Smith ..... G09F 11/29 160/351
6,807,999 B1 * 10/2004 Bowen ..... E01F 13/028 160/24
D554,478 S * 11/2007 Robinson ..... D8/356
7,877,914 B2 2/2011 Taylor et al.
7,909,310 B2 * 3/2011 Weiner ..... E01F 13/028 256/45
8,793,911 B2 8/2014 English
8,813,401 B2 * 8/2014 Diercks ..... F41J 1/10 273/407

FOREIGN PATENT DOCUMENTS

CN 201480883 U 5/2010

* cited by examiner

*Primary Examiner* — Cassandra Davis
(74) *Attorney, Agent, or Firm* — Salter & Michaelson

(57) ABSTRACT

A banner unit has a retractable storage position and a display position. The banner unit includes a pair of elongated rigid support posts, and a banner sheet that is comprised of a pair of one and other banner segments that each have opposed one and other side edges. The one side edge of each banner segment is secured to respective elongated rigid support posts. The banner unit also includes an elongated tubular sleeve constructed and arranged to be disposed in parallel with both of the pair of elongated rigid support posts, with the other side edge of each banner segment being secured to the elongated tubular sleeve. Each banner segment is constructed and arranged with a re-coil or retractable characteristic providing a tendency to form into a closed coil configuration when the elongated rigid support posts are brought together.

18 Claims, 9 Drawing Sheets

RETRACTABLE BANNER

FIELD OF THE INVENTION

The present invention relates in general to a retractable banner. More particularly, the present invention relates to an improved and simplified retractable banner that does not require complex mechanisms for retraction. More particularly, the present invention relates to a retractable banner that is constructed and arranged with a recoil characteristic providing a tendency (memory) that essentially automatically forms the banner material into a closed coil configuration.

BACKGROUND OF THE INVENTION

There are a significant number of patents that exist pertaining to retractable banners. One example is found in U.S. Pat. No. 7,877,914 to Taylor et al. One of the problems associated with existing banners is that they usually require some type of a rather complex mechanism for retracting and extending the banner.

It is an object of the present invention to provide an improved banner apparatus having a closed storage position and an open display position and in which separate segments of the banner material are constructed and arranged with a retractable memory characteristic providing a bias to a closed coil configuration.

Another object of the present invention is to provide a method of displaying a banner by using the banner apparatus of the present invention. This method includes providing alternate set-up and closed steps including a set-up step for maintaining rigid support posts spaced in parallel or alternatively a closed step in which the posts are separated adjacent to each other and spaced by a minimum distance.

Still a further object of the present invention is to provide a banner apparatus having a closed storage position and an open display position and that is comprised of a banner sheet comprised of a pair of banner segments that are interconnected at a middle section and that are each constructed and arranged with a retractable memory characteristic that is adapted to have a memory where the banner segments are in a closed coil configuration.

SUMMARY OF THE INVENTION

To accomplish the foregoing and other objects, features and advantages of the present invention there is provided a banner unit having a retractable storage position and a display position. The banner unit comprises a pair of elongated rigid support posts, and a banner sheet that is comprised of a pair of one and other banner segments that each have opposed one and other side edges, with the one side edge of each banner segment being secured to respective elongated rigid support posts along a length thereof The banner unit also includes an elongated tubular sleeve constructed and arranged to be disposed in parallel with both of the pair of elongated rigid support posts, the other side edge of each banner segment being secured to the elongated tubular sleeve. Each banner segment is constructed and arranged with a re-coil or retractable characteristic providing a tendency (memory) to form into a closed coil configuration when the elongated rigid support posts are brought together.

In accordance with other aspects of the present invention the banner segments have, on at least one side surface thereof, displayed information; the displayed information includes one of graphics, alpha characters and numeric characters; each of the pair of elongated rigid support posts has a bottom spiked end for ground engagement; each of the pair of elongated rigid support posts has a pair of parallel arranged spiked ends for ground engagement; further including a loop at a top end of each of the pair of elongated rigid support posts; wherein, in the display position, the elongated rigid support posts are maintained in parallel and are separated by a maximum separation distance therebetween; and wherein, in the retractable storage position, the elongated rigid support posts are maintained in parallel and are separated by a minimum separation distance therebetween.

In accordance with another embodiment of the present invention there is provided a banner apparatus having a closed storage position and an open display position. The banner apparatus comprises a pair of elongated rigid support posts, and a banner sheet that is comprised of a pair of one and other banner segments that each have opposed one and other side edges, the one side edge of each banner segment being secured to respective elongated rigid support posts along a length thereof, and a resilient middle piece constructed and arranged to be disposed in parallel with both of the pair of elongated rigid support posts, the other side edge of each banner segment being secured at the resilient middle piece. Each banner segment is constructed and arranged with a retractable memory characteristic providing a tendency to form into a closed coil configuration when the elongated rigid support posts are brought together.

In accordance with other aspects of the present invention the banner segments have, on at least one side surface thereof, displayed information; each of the pair of elongated rigid support posts has a bottom spiked end for ground engagement; further including a loop at a top end of each of the pair of elongated rigid support posts; wherein, in the open display position, the elongated rigid support posts are maintained in parallel and are separated by a maximum separation distance therebetween; and wherein, in the closed storage position, the elongated rigid support posts are maintained in parallel and are separated by a minimum separation distance therebetween.

In accordance with another embodiment of the present invention there is provided a method of displaying a banner by providing a banner unit having a retractable storage position and a display position. The banner unit comprises a pair of elongated rigid support posts, and a banner sheet that is comprised of a pair of one and other banner segments that each have opposed one and other side edges, the one side edge of each banner segment being secured to respective elongated rigid support posts along a length thereof, and an elongated tubular sleeve constructed and arranged to be disposed in parallel with both of the pair of elongated rigid support posts, the other side edge of each banner segment being secured to the elongated tubular sleeve. Each said banner segment is constructed and arranged with a re-coil or retractable characteristic providing a tendency to form into a closed coil configuration when the elongated rigid support posts are brought together. The method includes providing alternate set-up and closed steps comprised of the set-up step including maintaining the elongated rigid support posts in parallel and separated by a maximum separation distance therebetween, while fixedly securing the bottom end of each of the pair of elongated rigid support posts in order to maintain the maximum separation distance therebetween, and alternatively of the closed step including maintaining the elongated rigid support posts in parallel and separated by a minimum separation distance therebetween.

In accordance with other aspects of the present invention the closed step is accomplished without the bottom ends of the elongated rigid support posts being fixedly secured; wherein, in the display position, the bottom ends of the respective elongated rigid support posts are secured by engagement with a ground surface; wherein each of the pair of elongated rigid support posts has a bottom spiked end for ground engagement; and further including providing a loop at a top end of each of the pair of elongated rigid support posts.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Reference is now made to the drawings herein that show a preferred embodiment of the banner apparatus of the present invention. The banner apparatus maybe considered as having a closed storage position such as illustrated in the perspective view of FIG. 1 or an extended opened display position such as shown in the perspective views of FIGS. 4, 5 and 7. While FIGS. 1-7 illustrate one embodiment of the present invention, an alternate mounting arrangement is illustrated in FIGS. 8-12 and will be described in further detail hereinafter.

Figure 1:
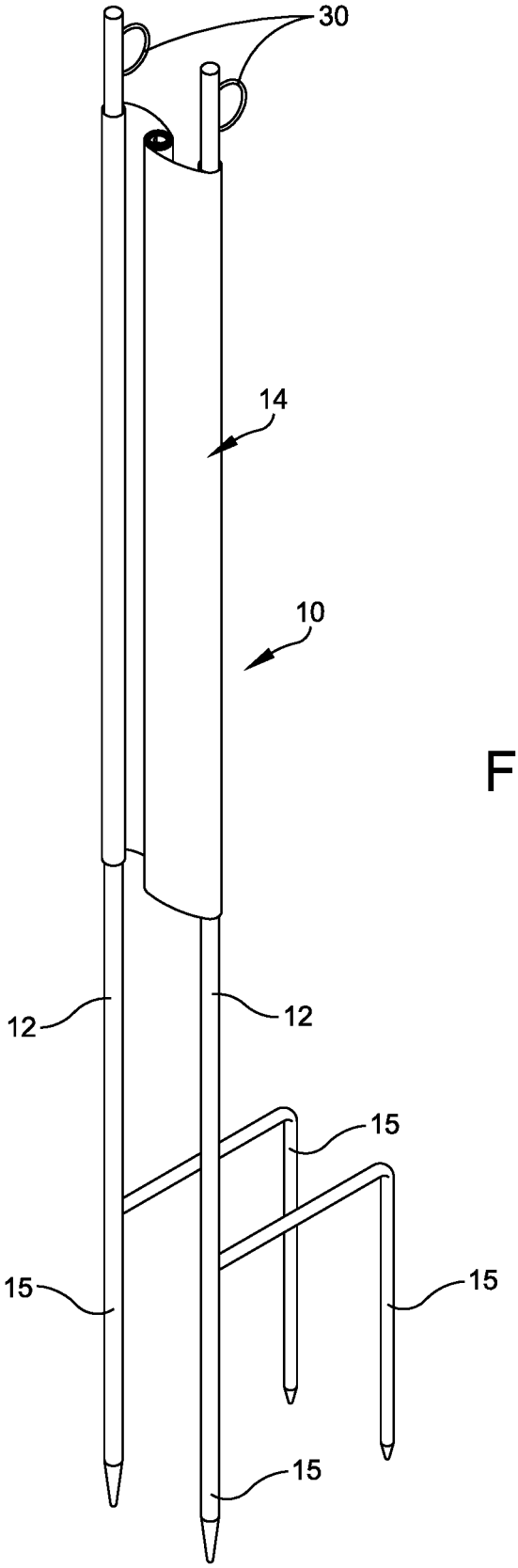
FIG. 1 is a perspective view of the banner apparatus of the present invention in its storage or retracted position.
Figure 2:
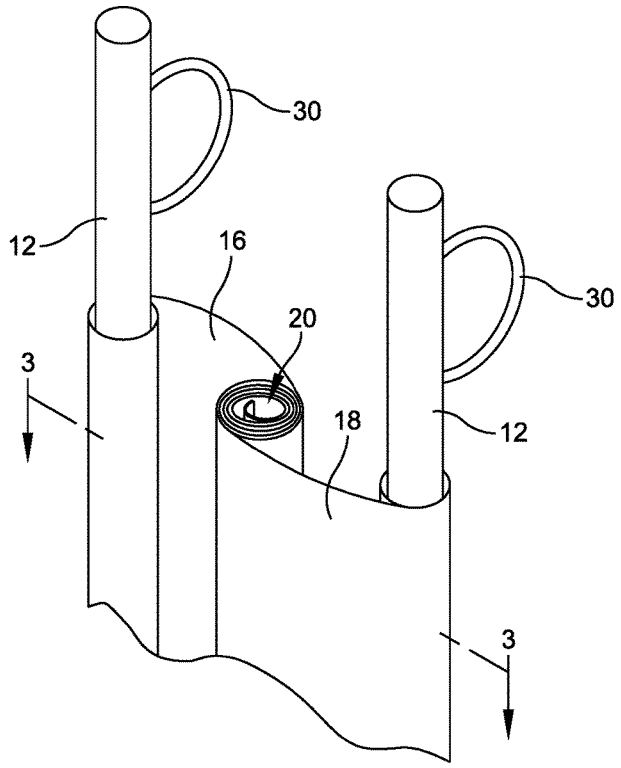
FIG. 2 is a fragmentary perspective view at a top area of the banner apparatus of FIG. 1.

As indicated previously, FIG. 1 is a perspective view illustrating the banner apparatus 10 in its closed position also referred to herein as a storage position. The banner apparatus 10 is comprised of a pair of elongated rigid support posts 12 and a banner sheet 14. The banner sheet 14, such as illustrated in FIG. 4, is considered as comprised of a pair of banner segments 16, 18. Each of the banner segments may be considered as having opposed one and other sides. The one side edge of each banner segment is secured to a respective elongated rigid support post 12. This is illustrated, for example, in FIG. 4 as being secured at the respective sides at 13. Thus, each of the inner segments 16 and 18 are secured to respective posts 12 along a length thereof. This securing may be by the use of an adhesive so that one side of each banner segments is fixed to a corresponding rigid support post 12. An adhesive is illustrated at 17 in FIG. 3 between a side of the banner segment and the corresponding rigid support post 12. In FIG. 4 the arrows A indicate the opening of the banner by stretching the banner material (pulling the posts 12 apart) in the direction of arrows A.

Figure 6:
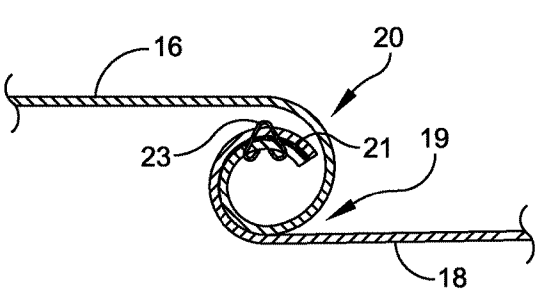
FIG. 6 is a cross-sectional view taken along line 6-6 of FIG. 5 and illustrated particularly at the middle between the banner segments.

As also illustrated in, for example, FIG. 6, in the middle of the banner where the segments 16 and 18 connect, there is provided a resilient middle piece 20. The piece 20 is also referred to herein as an elongated tubular sleeve that is constructed and arranged to be disposed in parallel with both of the pair of elongated rigid support posts 12, and that is formed by the joining of respective other sides of the segments 16, 18. The other side edges of each banner segment 16, 18 are joined at the resilient middle piece as indicated at 19 in FIG. 6.

Figure 4:
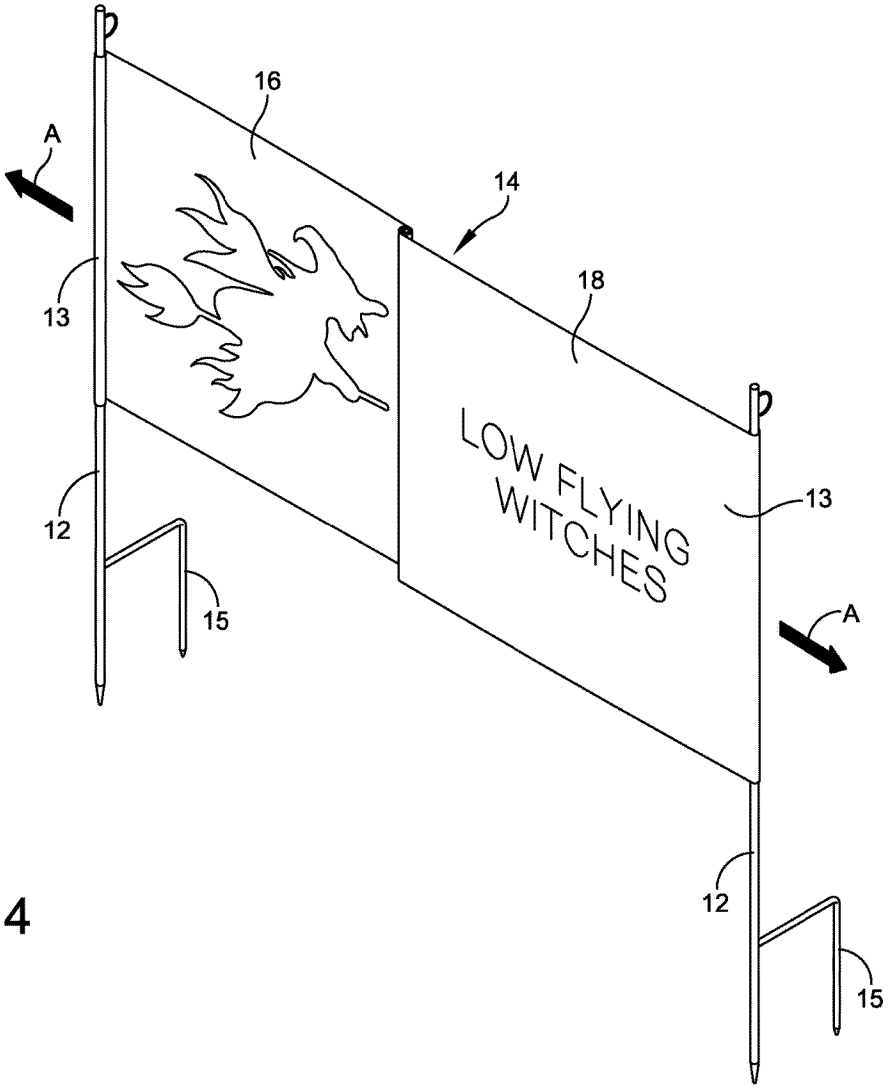
FIG. 4 is a perspective view showing the banner apparatus of the present invention in a fully extended display position.
Figure 5:
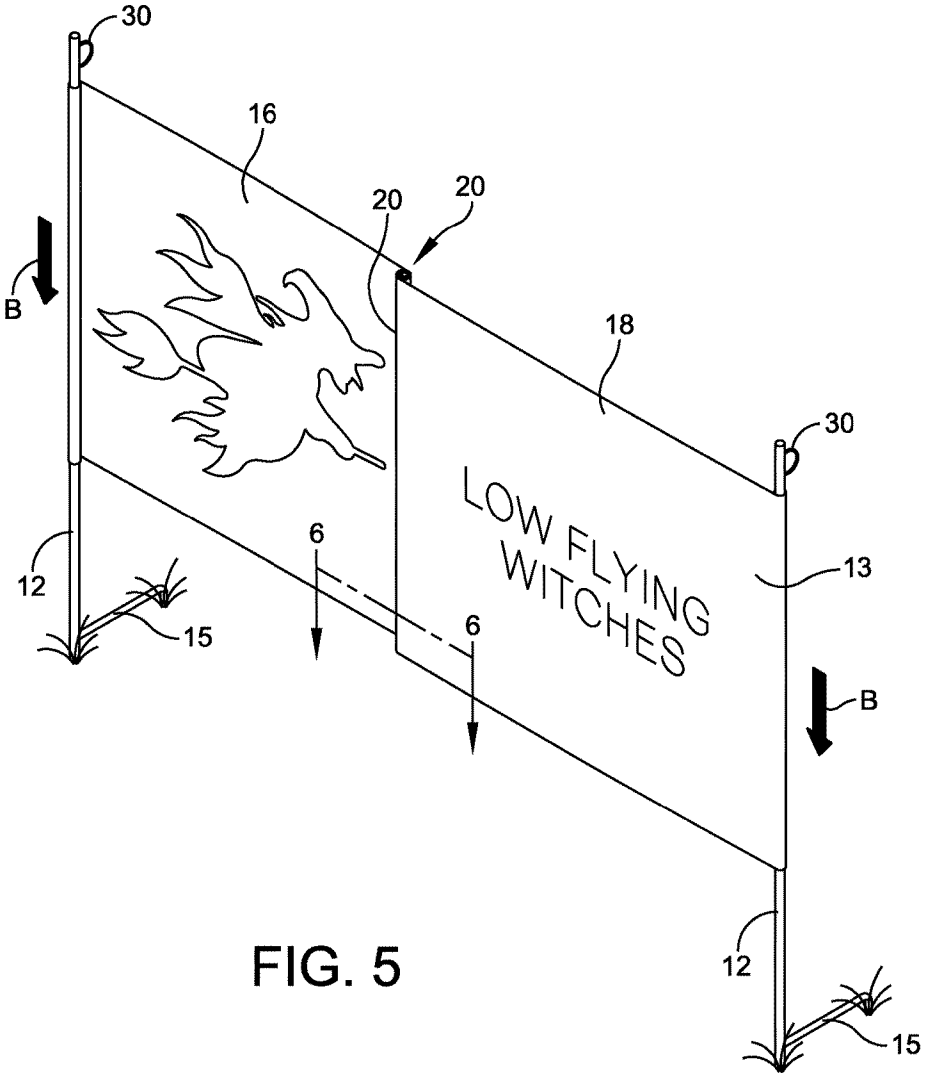
FIG. 5 is a perspective view of the banner apparatus in the display position with the support posts secured into a ground surface.
Figure 7:
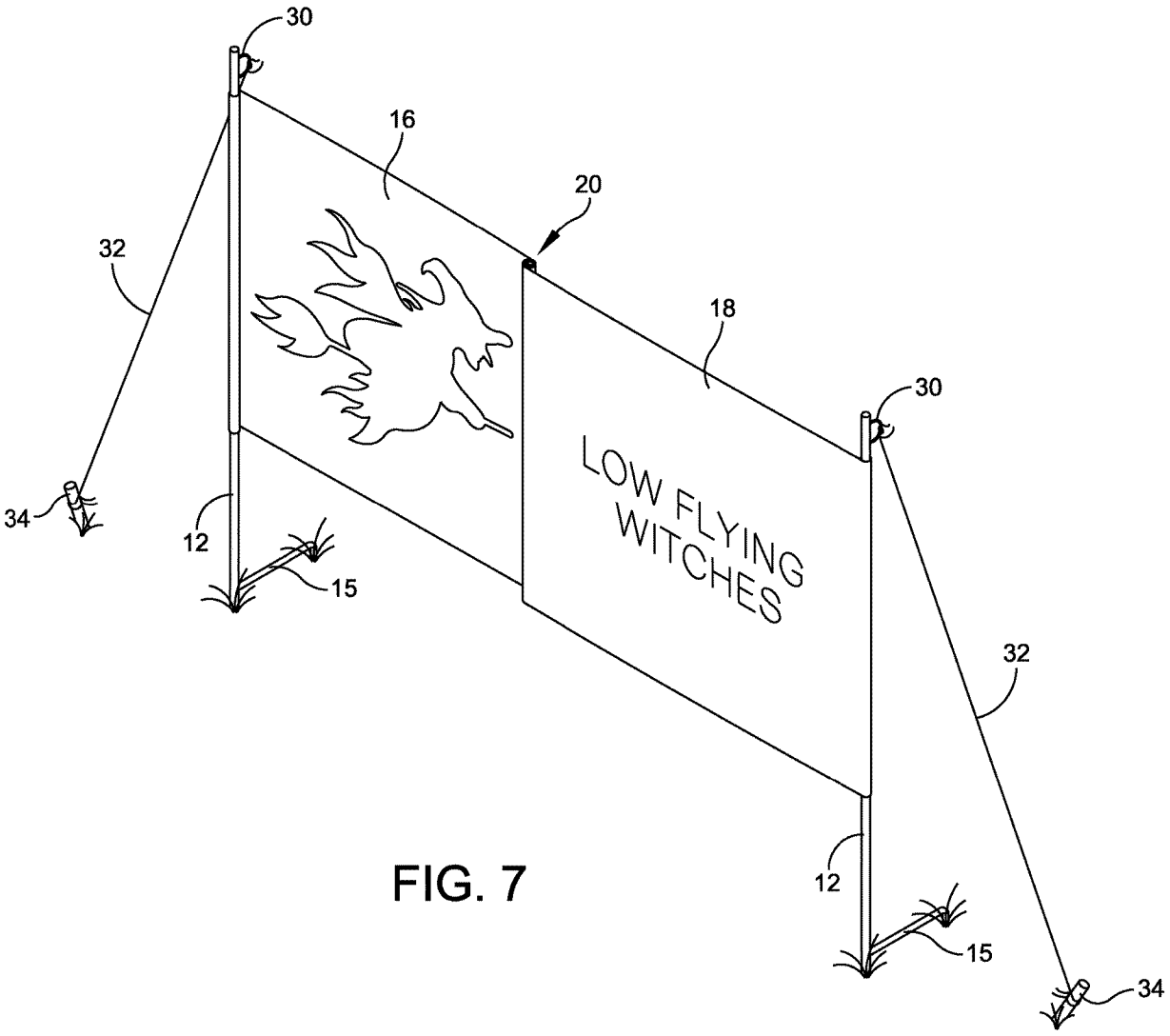
FIG. 7 is a perspective view of the banner apparatus in its display position and further illustrating additional means for securing the banner in a stationery position.

As illustrated in FIGS. 4 and 5, each of the segments 16, 18 have on at least one side surface thereof displayed information. This is illustrated, for example, in FIG. 5 wherein the banner segment 16 has the outline of a "witch." The displayed information on the banner segment 18 is illustrated as "writing". Thus, the displayed information may be graphics, alpha characters, numeric characters or any other displayable information or objects. This information may be provided on one side or opposed sides of each or both banner segments 16, 18. The displayed information may also be coordinated so that an image, or the like, can extend across the respective banner segment 16, 18. In FIG. 5 the arrows B are illustrative of the securing of the banner by means of engaging the stakes 15 into a ground surface. The same is also illustrated in FIG. 7.

The material for the banner is primarily a thermoplastic which will hold its shape. The normal position is a closed position such as shown in FIG. 1 wherein the material itself is constructed with a built in memory. This means that, if the banner material is opened, such as to the position shown in FIG. 4, there is a material memory that automatically forces the material to go back to its stable state; the stable state being a closed coiled position of the banner material. Thus, once the force to separate the banner material is relinquished, the memory of the material provides a biasing force to close the material toward the position of FIG. 1. This closed position is most convenient for transporting the banner. The material for each banner segment, in one embodiment, is made of PET (Polyethylene terephthalate) supported on an aluminum foil material. Then one more OPP (orientated polypropylene) material is coated on the PET side for easy printing purpose. This material is combined by PET and Alum foil in certain percentage. The combined PET/Foil material itself will have the rolling back memory characteristic.

With regard to the elongated rigid support posts, they are preferably provided at a top end thereof with a hook 30. The hook 30, as illustrated in FIG. 7, may be used as an attachment point for an additional securing member. In FIG. 7 this is illustrated by a cord 32 attached at each hook 30 and secured to the ground by means of a stake 34. With further reference to FIG. 1, the bottom end of each of the elongated rigid support posts 12 is provided with at least one spiked end 15. Actually, in the embodiment of FIG. 1, a pair of parallel spike ends 15 is provided to assist in engaging each of the elongated rigid support posts into a ground surface such as illustrated in FIG. 5. FIG. 5 shows the banner apparatus secured into the ground surface.

Figure 3:
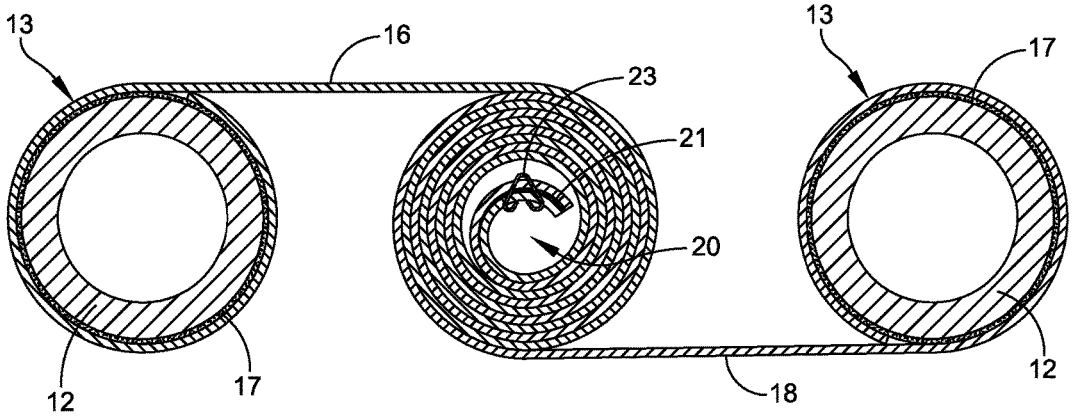
FIG. 3 is a cross-sectional view taken along line 3-3 of FIG. 2 with the banner in a basically closed or retracted position.

The cross-sectional view of FIG. 3 illustrates a more closed position of the banner segments 16, 18. At the middle piece 20 it is formed as a tubular sleeve where an adhesive 21 can also be used to secure the joined ends of the respective banner segments 16, 18. Refer to FIGS. 3 and 6. Also show in FIG. 3 is a staple 23 used to secure the respective ends of the segments that essentially form the tubular sleeve 20. In this regard refer also to the cross-sectional view of FIG. 6 wherein the banner segments are in a display or open position thus, leaving the tubular sleeve 20 as the means by which the respective banner segments 16, 18 are joined. This joining provides essentially a single piece banner. In the display position the diameter of the tubular sleeve is small in comparison to the width of each banner segment 16, 18.

Figure 8:
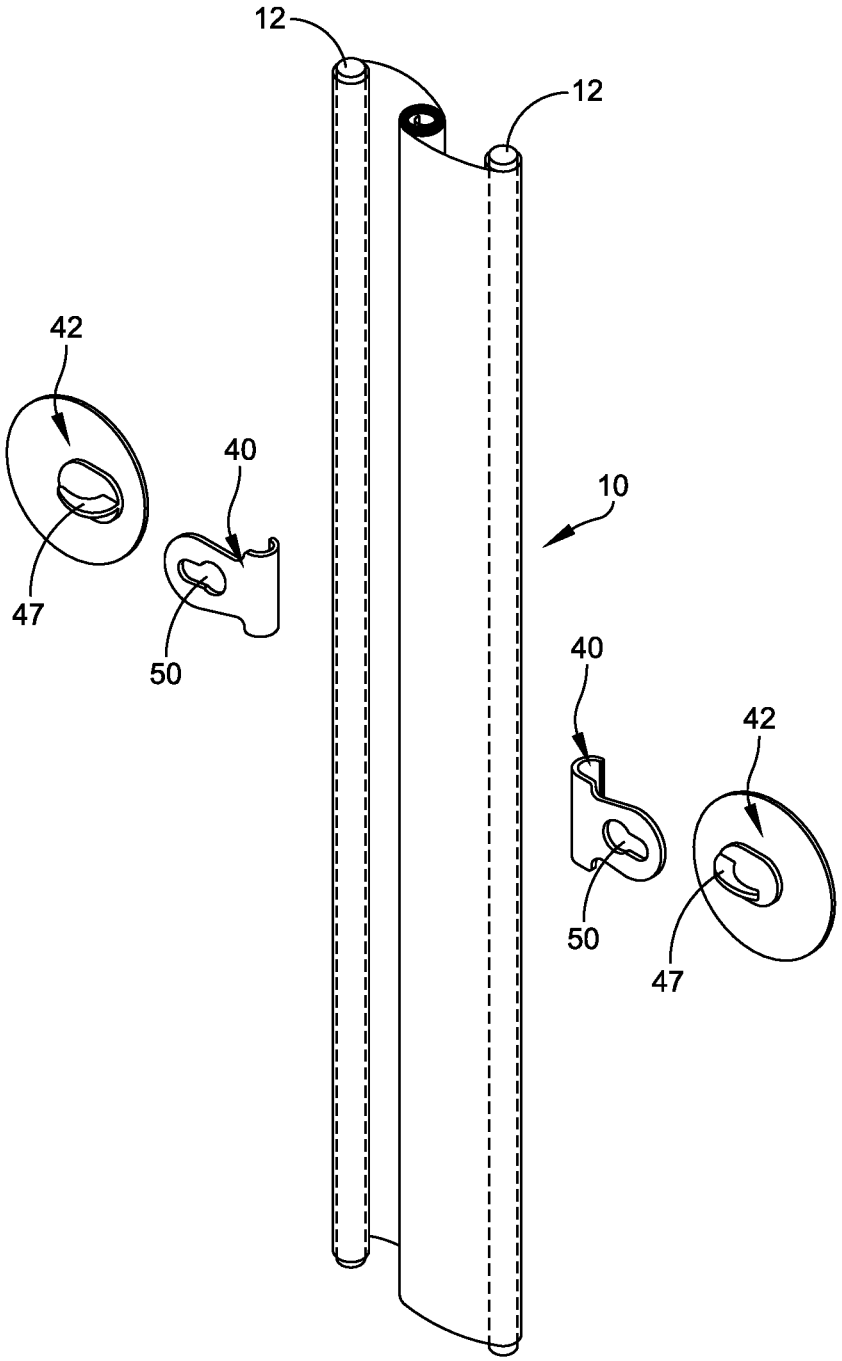
FIG. 8 is a perspective view of the banner apparatus of the present invention in a storage or retracted position showing an alternate arrangement for securing the banner.
Figure 9:
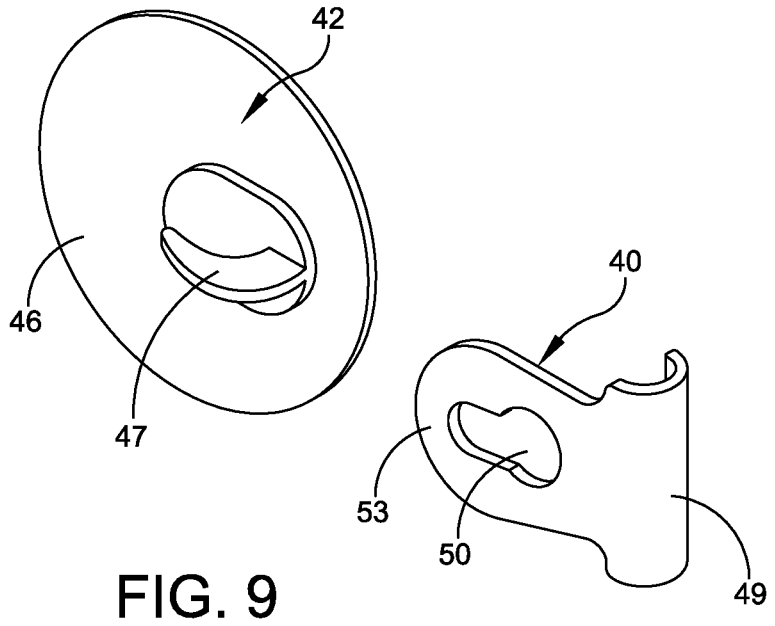
FIG. 9 is a perspective view of the hook and catch mechanism in an unhooked position.
Figure 10:
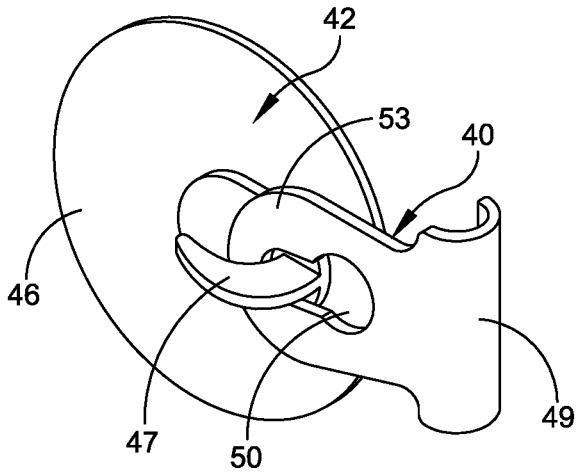
FIG. 10 is a perspective view of the hook and catch mechanism in a secured position.
Figure 11:
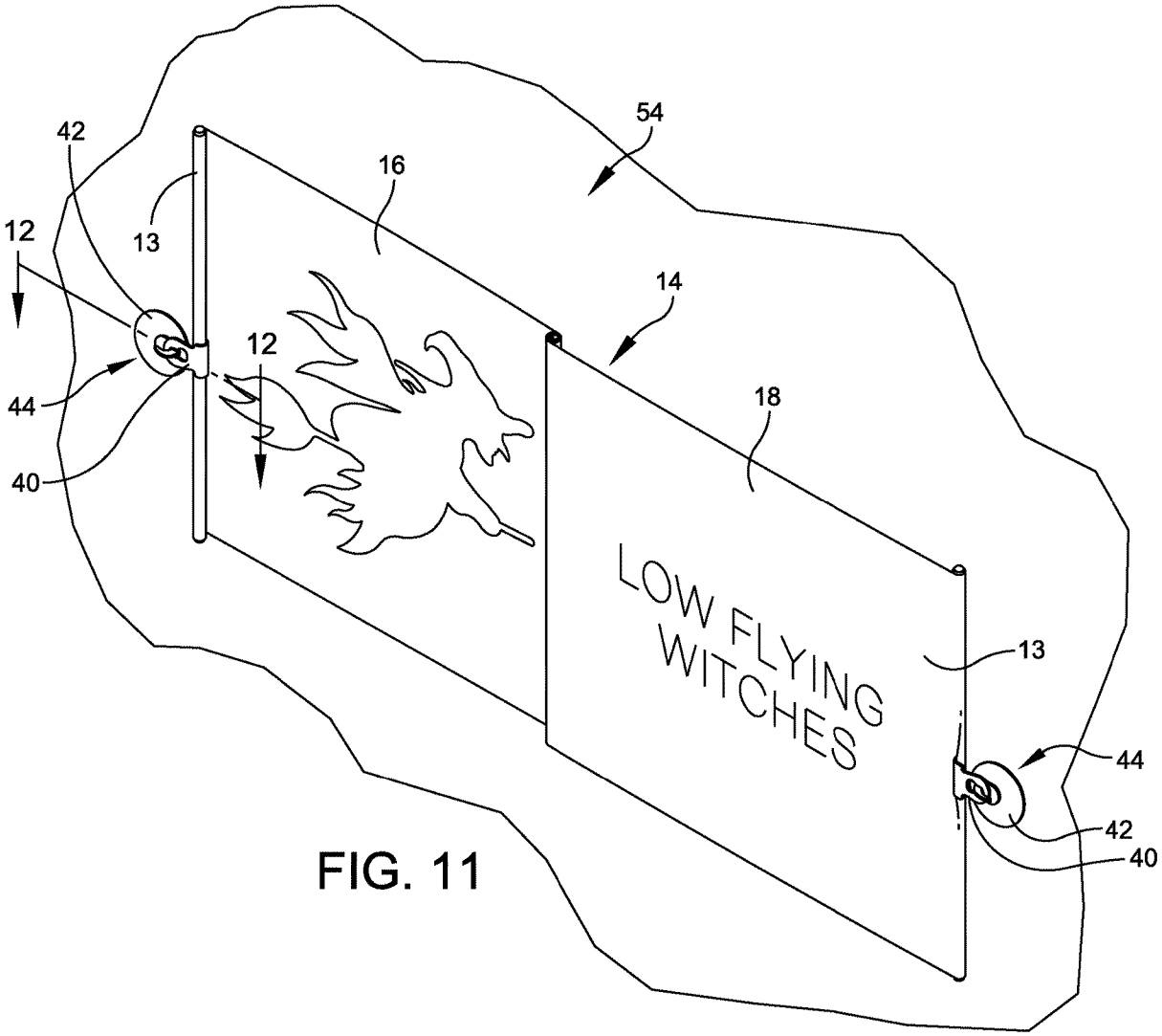
FIG. 11 is a perspective view of the entire banner apparatus in this alternate embodiment showing the use of the hook and catch mechanism.
Figure 12:
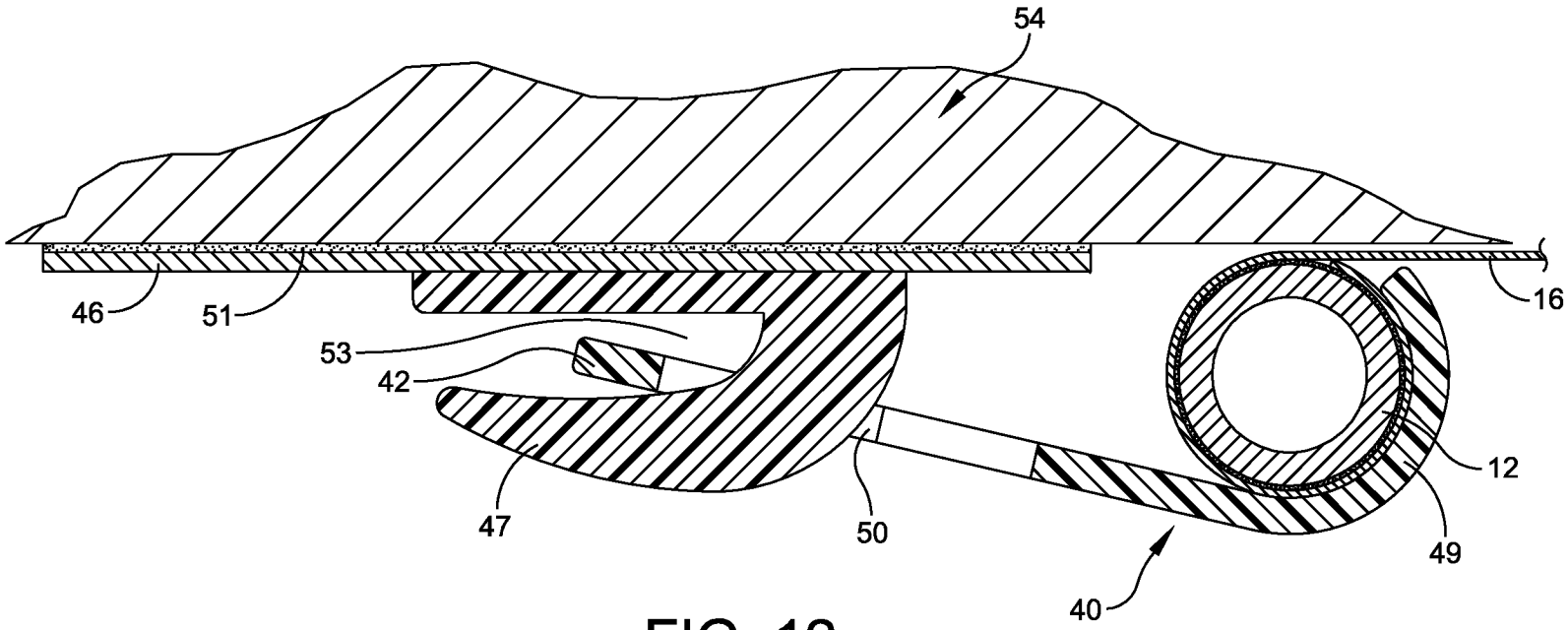
FIG. 12 is a cross-sectional view taken along line 12-12 of FIG. 11.

Reference is now made to FIGS. 8-12 for an alternate embodiment of the present invention that enables attachment of the banner apparatus or banner unit 10 to an alternate support surface such as the surface 54 illustrated in FIG. 12. The banner apparatus 10 is comprised of a pair of elongated rigid support posts 12 and a banner sheet 14. The banner sheet 14, such as illustrated in FIGS. 8 and 11, is considered as comprised of a pair of banner segments 16, 18. Each of the banner segments may be considered as having opposed one and other sides. The one side edge of each banner segment is secured to a respective elongated rigid support post 12. This is illustrated, for example, in FIG. 11 as being secured at the respective sides at 13. Thus, each of the inner segments 16 and 18 are secured to respective posts 12 along a length thereof. This securing may be by the use of an adhesive so that one side of each banner segment is fixed to a corresponding rigid support post 12.

In the first embodiment described, these rigid support posts 12 have a bottom end that enables these posts to be inserted into a ground surface. In the alternate embodiment of FIGS. 8-12, the banner is meant for support from a sidewall of some type which maybe, for example, a garage door or large window. Thus, as noted in FIGS. 8 and 11, each of the rigid support posts are of the same length as that of the banner apparatus. The support posts may be moved from the position of FIG. 8 to the position of FIG. 11 in a manner as previously described and each of the respective support posts 12 are then fixed in position by means of the catch member 40 and hook member 42. These items provide the illustrated hook and catch mechanism 44. As indicated previously, this mechanism is shown in an unlatched position in FIG. 9 and in a latch position in FIG. 10.

The catch member 40 is comprised of a curved shape end catch 49 and a section that is orthogonal to the catch 49 that includes the hole 50. The catch 49 is adapted to snap interlock about the respective support posts 12 such as illustrated in the cross sectional view of FIG. 12.

The hook member 42 is comprised of a base piece 46 and a hook 47 that defines an open recess 48. FIGS. 11 and 12 illustrate the base 46 secured in position to the wall 54. The base 46 may be secured by means of an adhesive shown at 51 in FIG. 12. Alternatively, the base 46 may be in the form of a suction cup depending upon the particular application. In still another embodiment the base 46 may be secured in any manner to the upright surface 54, such as by being screwed to the surface 54. Also, mechanisms other than the catch and hook arrangement may be used so that the banner can be substantially permanently attached to the upright wall surface. This may be by screwing the member 42 directly to the upright wall structure. Once the hook member 42 is in position with the respective hook members being disposed a distance apart, such as illustrated in FIG. 11, then the banner 14 can be stretched to its extended position as illustrated in FIG. 11. The extending end wall 53 of the catch member 40 then engages with the hook 47. The hook 47, as illustrated in FIG. 10, engages the wall 53 at the hole 50 thus securing the opposed left and right ends of the banner illustrated in FIG. 11.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A banner unit having a retractable storage position and a display position, said banner unit comprising a pair of elongated rigid support posts, and a banner sheet that is comprised of a pair of one and other banner segments that each have opposed one and other side edges, the one side edge of each banner segment being secured to respective elongated rigid support posts, extending circumferentially about each rigid support post and disposed along a length of each rigid support post, the other side edge of each banner segment being joined together along the length of each other side edge, each said banner segment being constructed and arranged with a re-coil or retractable memory characteristic providing a tendency to form into a closed coil configuration when the elongated rigid support posts are allowed to come together, wherein each of the pair of elongated rigid support posts has a bottom spiked end for ground engagement, each spiked end extending below the banner sheet so as to position a bottom edge of the segments above a ground surface, and wherein the one side edge of both banner segments is secured by an adhesive disposed about substantially the entire circumference and substantially the entire length of each elongated rigid support post, and the other side edge of each banner segment is joined by means of one of an adhesive and a staple.

2. The banner unit of claim 1 wherein the banner segments have, on at least one side surface thereof, displayed information.

3. The banner unit of claim 2 wherein the displayed information includes one of graphics, alpha characters and numeric characters, and further including opposed side securing pieces that each comprise a catch and hook member.

4. The banner unit of claim 1 wherein each of the bottom spiked ends has a pair of parallel arranged spiked ends for ground engagement.

5. The banner unit of claim 1 further including a loop at a top end of each of the pair of elongated rigid support posts.

6. The banner unit of claim 1 wherein, in the display position, the elongated rigid support posts are maintained in parallel and are separated by a maximum separation distance therebetween.

7. The banner unit of claim 6 wherein, in the retractable storage position, the elongated rigid support posts are maintained in parallel and are separated by a minimum separation distance therebetween.

8. A banner apparatus having a closed storage position and an open display position, said banner apparatus comprising a pair of elongated rigid support posts, and a banner sheet that is comprised of a pair of one and other banner segments that each have opposed one and other side edges, the one side edge of each banner segment being secured to respective elongated rigid support posts, extending about each rigid support post and disposed along a length of each rigid support post, the other side edge of each banner segment being joined together and extending along a length of each other side edge, each said banner segment being constructed and arranged with a retractable memory characteristic providing a tendency to form into a closed coil configuration when the elongated rigid support posts are brought together, in combination with an upright wall, a pair of support hook members and a pair of catch members, said hook members attached to the upright wall at spaced apart location on the upright wall, and the pair of catch members each for releasable engagement with a respective elongated rigid support post at one end thereof and for engagement with a respective hook member at an opposed end thereof, wherein, in the closed storage position, the elongated rigid support posts are maintained in parallel, wherein, in the open position said catch member extends only partially about the elongated rigid support post, wherein said elongated rigid support posts are each cylindrical in shape, wherein said one end of said catch member has a partially curved shape to match the shape of the cylindrical support post, and wherein the one side edge of both banner segments is secured by an adhesive disposed about substantially the entire circumference and substantially the entire length of each elongated rigid support post, and the other side edge of each banner segment is joined by means of one of an adhesive and a staple.

9. The banner apparatus of claim 8 wherein the banner segments have, on at least one side surface thereof, displayed information.

10. The banner apparatus of claim 8 wherein each of the pair of elongated rigid support posts has a bottom spiked end for ground engagement.

11. The banner apparatus of claim 8 further including a loop at a top end of each of the pair of elongated rigid support posts.

12. The banner apparatus of claim 8 wherein, in the open display position, the elongated rigid support posts are maintained in parallel and are separated by a maximum separation distance therebetween.

13. A method of displaying a banner by providing a banner unit having a retractable storage position and a display position, said banner unit comprising a pair of elongated rigid support posts, and a banner sheet that is comprised of a pair of one and other banner segments that each have opposed one and other side edges, the one side edge of each banner segment being secured to respective elongated rigid support posts along a length thereof,-each said banner segment being constructed and arranged with a re-coil or retractable characteristic providing a tendency to form into a closed coil configuration when the elongated rigid support posts are brought together, said method including alternate set-up and closed steps comprised of the set-up step including maintaining the elongated rigid support posts in parallel and separated by a maximum separation distance therebetween, while fixedly securing the bottom end of each of the pair of elongated rigid support posts in order to maintain the maximum separation distance therebetween, and alternatively of the closed step including maintaining the elongated rigid support posts in parallel and separated by a minimum separation distance therebetween, and further including providing each of the pair of elongated rigid support posts having a bottom spiked end for ground engagement, each spiked end extending below the banner sheet so as to position a bottom edge of the segments above a ground surface, and wherein the one side edge of both banner segments is secured by an adhesive disposed about substantially the entire circumference and substantially the entire length of each elongated rigid support post, and the other side edge of each banner segment is joined by means of one of an adhesive and a staple.

14. A banner unit having a retractable storage position and a display position, in combination with an upright wall surface to which the banner unit is secured by means of a securing mechanism, said banner unit comprising a pair of elongated rigid support posts, and a banner sheet that is comprised of a pair of one and other banner segments that each have opposed one and other side edges, the one side edge of each banner segment being secured to respective elongated rigid support posts along a length thereof, the other side edge of each banner segment being joined together along the length of each other side edge, each said banner segment being constructed and arranged with a re-coil or retractable memory characteristic providing a tendency to form into a closed coil configuration when the elongated rigid support posts are allowed to come together, and wherein the securing mechanism comprises a catch member and a hook member, wherein said hook member including a hook and said catch member including a catch that extends about the elongated rigid support post and having a hole through which the hook extends, said catch, at one end thereof having a partially curved shape that engages only partially circumferentially about the rigid support post, wherein the elongated rigid support posts each are cylindrical, wherein said one end of said catch has the curved shape so as to match the cylindrical shape of the cylindrical support post, said hook member for selective engagement with said catch member in order to maintain said banner sheet in said display position, and wherein the one side edge of both banner segments is secured by an adhesive disposed about substantially the entire circumference and substantially the entire length of each elongated rigid support post, and the other side edge of each banner segment is joined by means of one of an adhesive and a staple.

15. A banner unit having a retractable storage position and a display position, said banner unit comprising a pair of elongated rigid support posts, and a banner sheet that is comprised of a pair of one and other banner segments that each have opposed one and other side edges, the one side edge of each banner segment being secured to respective elongated rigid support posts, extending circumferentially about each rigid support post and disposed along a length of each rigid support post, the other side edge of each banner segment being joined together along the length of each other side edge, each said banner segment being constructed and arranged with a re-coil or retractable memory characteristic providing a tendency to form into a closed coil configuration when the elongated rigid support posts are allowed to come together, and wherein each of the pair of elongated rigid support posts has a bottom spiked end for ground engagement, each spiked end extending below the banner sheet so as to position a bottom edge of the segments above a ground surface and wherein the one side edge of both banner segments is secured by an adhesive disposed about a circumference of each elongated rigid support post, and the other side edge of each banner segment is joined by means of one of an adhesive and a staple.

16. A banner apparatus having a closed storage position and an open display position, said banner apparatus comprising a pair of elongated rigid support posts, and a banner sheet that is comprised of a pair of one and other banner segments that each have opposed one and other side edges, the one side edge of each banner segment being secured to respective elongated rigid support posts, extending about each rigid support post and disposed along a length of each rigid support post, the other side edge of each banner segment being joined together and extending along a length of each other side edge, each said banner segment being constructed and arranged with a retractable memory characteristic providing a tendency to form into a closed coil configuration when the elongated rigid support posts are brought together, in combination with an upright wall, a pair of support hook members and a pair of catch members, said hook members attached to the upright wall at spaced apart location on the upright wall, and the pair of catch members each for releasable engagement with a respective elongated rigid support post at one end thereof and for engagement with a respective hook member at an opposed end thereof, wherein, in the closed storage position, the elongated rigid support posts are maintained in parallel, wherein said catch member extends about the elongated rigid support post, wherein said elongated rigid support posts are each cylindrical in shape, and wherein said one end of said catch member has a curved shape to match the shape of the cylindrical support post and wherein the one side edge of both banner segments is secured by an adhesive disposed about substantially the entire circumference and substantially the entire length of each elongated rigid support post, and the other side edge of each banner segment is joined by means of one of an adhesive and a staple.

17. A banner apparatus having a closed storage position and an open display position, said banner apparatus comprising a pair of elongated rigid support posts, and a banner sheet that is comprised of a pair of one and other banner segments that each have opposed one and other side edges, the one side edge of each banner segment being secured to respective elongated rigid support posts, extending about each rigid support post and disposed along a length of each rigid support post, the other side edge of each banner segment being joined together and extending along a length of each other side edge, each said banner segment being constructed and arranged with a retractable memory characteristic providing a tendency to form into a closed coil configuration when the elongated rigid support posts are brought together, in combination with an upright wall, a support assembly that includes pair of hook members and a pair of catch members for supporting the support posts from the upright wall in the open display position, one of said hook members and catch members including a curved attachment end that is for releasable engagement with an elongated rigid support post, each said elongated rigid support post being cylindrical in shape, wherein, in the closed storage position, the elongated rigid support posts are maintained in parallel, wherein, in the open display position, said curved end engages only partially circumferentially about the elongated rigid support post, and wherein said curved end has the partially curved shape arranged so as to match the shape of the cylindrical support post, and wherein the one side edge of both banner segments is secured by an adhesive disposed about substantially the entire circumference and substantially the entire length of each elongated rigid support post, and the other side edge of each banner segment is joined by means of one of an adhesive and a staple.

18. The banner apparatus of claim 17 wherein the catch member has the curved end and a hole and the hook member includes a hook for engaging with the hole in the catch member.

* * * * *